US005570635A

United States Patent [19]

Stadler

[11] Patent Number: 5,570,635

[45] Date of Patent: Nov. 5, 1996

[54] PREGRIPPER OF SHEET-FED PRINTING PRESS

[75] Inventor: Lothar Stadler, Eppelheim, Germany

[73] Assignee: Heidelberger Druckmaschinen AG, Heidelberg, Germany

[21] Appl. No.: 514,773

[22] Filed: Aug. 14, 1995

[30] Foreign Application Priority Data

Aug. 12, 1994 [DE] Germany ..... 44 28 592.2

[51] Int. Cl.[6] ..... B41F 21/04

[52] U.S. Cl. ..... 101/409; 271/277

[58] Field of Search ..... 101/232, 409, 101/410, 375, 378, 231; 271/277

[56] References Cited

U.S. PATENT DOCUMENTS

| | | | |
|---|---|---|---|
| 2,865,289 | 12/1958 | Fowlie et al. | 101/409 |
| 3,463,484 | 8/1969 | Rudolph | 101/409 |
| 4,101,122 | 7/1978 | Jeschke et al. | 271/277 |
| 4,900,008 | 2/1990 | Fichter et al. | 271/277 |
| 5,076,165 | 12/1991 | Pollich | 101/409 |
| 5,398,607 | 3/1995 | Fricke et al. | 101/409 |

FOREIGN PATENT DOCUMENTS

| | | |
|---|---|---|
| 800127 | 7/1949 | Germany . |
| 3508697 | 9/1989 | Germany . |
| 4233846 | 4/1994 | Germany . |
| 2271825 | 4/1994 | United Kingdom . |

*Primary Examiner*—Eugene H. Eickholt
*Attorney, Agent, or Firm*—Herbert L. Lerner; Laurence A. Greenberg

[57] ABSTRACT

Pregripper of a sheet-fed printing press includes a drive unit for pivotally driving a pregripper bar secured to a pregripper support device, the drive unit having main and auxiliary cam elements disposed on a drive shaft so as to be fixed against rotation relative thereto, and cam follower members cooperatively engaging with the cam elements so as to produce a movement of the pregripper bar, the pregripper support device engaging the pregripper bar approximately centrally for introducing a force to produce the pivoting movement.

15 Claims, 3 Drawing Sheets

PREGRIPPER OF SHEET-FED PRINTING PRESS

BACKGROUND OF THE INVENTION

Field of the Invention

The invention relates to a pregripper of a sheet-fed printing press having a drive unit for pivotally or swingably driving a pregripper bar secured to a pregripper support device, the drive unit having main and auxiliary cam elements disposed on a drive shaft so as to be fixed against rotation relative thereto, and cam follower members cooperatively engaging the cam elements so as to produce a movement of the pregripper bar.

Pregrippers of this general type have become known heretofore. They serve to grip a sheet of paper aligned by front and side lays and resting on a delivery table, and to accelerate the sheet to the press speed of the sheet-fed printing press. For this purpose, the pregripper has a pregripper bar which carries a number of mutually spaced-apart, row-wise arranged grippers. The grippers grip the sheet along the leading edge thereof and accelerate it as a result of the pivoting or swinging movement of the pregripper bar. The sheet is released approximately in the middle of the pivoting movement, which is at press speed. The pregripper bar swivels back into the starting position thereof so that it can grip the next sheet. To perform the pivoting or swiveling movement of the pregripper bar, a drive unit is assigned thereto which has main and auxiliary cam elements disposed thereon so as to be fixed against rotation relative thereto. These cam elements are set into rotary motion by the drive shaft and thereby deflect cam follower members moving along therewith. The cam follower members are formed as cam rollers, for example. These cam rollers are part of a transmission member, which is connected to a pregripper shaft so as to be fixed against rotation relative thereto, so that the cam rollers impart the deflecting movements thereof as a pivoting or swiveling movement to the transmission member, which causes corresponding rotary motion of the pregripper shaft. Due to the prescribed outer contour of the main cam element, the pregripper shaft is rotated a given angle in the sheet acceleration direction. The accessory or auxiliary cam element rests on the cam roller assigned thereto and controls the motion, so as to attain a maximum freedom from play. The outer contour of the auxiliary cam element is selected so that it effects a reverse or return motion of the transmission member, after the sheet acceleration movement, thereby causing a reverse rotation of the pregripper shaft. During this reverse rotary motion of the pregripper shaft, the main cam element rests on the cam roller associated therewith, in order to prevent excessive play from occurring there as well. The pregripper bar is disposed by means of a pregripper support assembly on the pregripper shaft so as to be fixed against rotation relative thereto, so that the pregripper bar executes a pivoting or swiveling movement corresponding to the rotary motion of the pregripper shaft. During operation, the sheet-fed pregripper bar is thus pivoted reciprocatively at a cadence or cycle dictated by the main and auxiliary cam elements. A transmission of force for performing this pivoting or swiveling motion is effected from the transmission member to the pregripper shaft, and from the latter, via the pregripper support assembly, to the pregripper bar. The pregripper support assembly has two pregripper supports, which extend radially and are disposed on both end regions of the pregripper bar. Particularly at high press speeds, for example when several thousand sheets are being transported per hour, torsional vibrations of the pregripper shaft can occur, which cause oscillations, particularly bending oscillations, of the pregripper bar. A result thereof can be uneven or nonuniform gripping by the grippers of the pregripper bar when the sheets to be accelerated are engaged, that is, the gripping being not always at the same place and possibly not at the same time. Because of this uneven gripping, the danger arises that the sheets, oriented or aligned beforehand by the side and front lays, will be delivered askew to the printing unit. To counteract these torsional and bending vibrations, an attempt has been made to damp them by constructing the machine or press elements very massively and rigidly, particularly by providing an oversized pregripper shaft. This requires increased space, and calls for additional material and considerably more weight.

SUMMARY OF THE INVENTION

It is accordingly an object of the invention to provide a pregripper of the foregoing general type which, despite a simple, non-oversized structure, performs a precise sheet delivery even at high press speeds.

With the foregoing and other objects in view, there is provided, in accordance with the invention, a pregripper of a sheet-fed printing press, comprising a drive unit for pivotally driving a pregripper bar secured to a pregripper support device, the drive unit having main and auxiliary cam elements disposed on a drive shaft so as to be fixed against rotation relative thereto, and cam follower members cooperatively engaging with the cam elements so as to produce a movement of the pregripper bar, the pregripper support device engaging the pregripper bar approximately centrally for introducing a force to produce the pivoting movement.

In accordance with another feature of the invention, the main and auxiliary cam elements are disposed in a region wherein the pregripper support device is located.

In accordance with a further feature of the invention, the drive shaft supports both the main and auxiliary cam elements in common.

In accordance with an added feature of the invention, the pregripper support device is formed with at least one opening through which the drive shaft extends.

In accordance with an additional feature of the invention, the pregripper support device is formed with a first and a second recess, respectively, assigned to the main cam element and the auxiliary cam element.

In accordance with yet another feature of the invention, the cam follower members associated with the main and auxiliary cam elements are formed as cam rollers and are mounted on the pregripper support device.

In accordance with yet a further feature of the invention, the pregripper support device is formed with a first and a second recess, respectively, assigned to the main cam element and the auxiliary cam element, and wherein the cam follower members are formed as cam rollers, the cam roller associated with the main cam element being disposed in the first recess.

In accordance with yet an added feature of the invention, the cam roller associated with the auxiliary cam element is disposed in the second recess.

In accordance with yet an additional feature of the invention, the pregripper support device has mutually spaced-apart first, second and third pregripper supports, the first recess being located between the first and the second pregripper supports, and the second recess being located between the second and the third pregripper supports.

In accordance with still another feature of the invention, the main and the auxiliary cam elements are disposed axially spaced apart from the respective pregripper supports of the pregripper support device.

In accordance with still a further feature of the invention, the cam elements are formed as cam rollers and are secured on at least two of the pregripper supports of the pregripper support device.

In accordance with still an added feature of the invention, the pregripper includes a pregripper shaft, and the pregripper supports, respectively, of the pregripper support device are formed with a slot disposed along a circular arc about the pregripper shaft, the drive shaft extending through the slots.

In accordance with still a further feature of the invention, the pregripper support device is mounted on the pregripper shaft, and the pregripper shaft forms a pivot shaft.

In accordance with still an additional feature of the invention, the pregripper includes a pregripper shaft and auxiliary supports for connecting the pregripper bar to the pregripper shaft, the auxiliary supports being associated with the pregripper support device.

In accordance with a concomitant feature of the invention, at least one of the auxiliary supports is disposed on each side of the pregripper support device.

Because the pregripper support assembly engages the pregripper bar approximately centrally and introduces thereat a force for performing the pivoting or swiveling motion, the drive forces transmitted by the drive unit are applied to the pregripper bar uniformly over the length and on both sides thereof.

Particularly because the force introduction is effected substantially centrally of the pregripper bar, this bar cannot be subject to any nonuniform bending oscillations or vibrations over the length thereof. Bending strains which might possibly arise are uniformly absorbed by the pregripper bar over the length thereof so that, in any operating situation, the sheets which are to be accelerated are uniformly engaged thereby. Assurance is thereby provided that the sheet, aligned or oriented at the side and front lays, will be accelerated evenly, thereby avoiding the feeding thereof in a skewed position to a processing unit, such as a printing unit, for example.

Thus, in an advantageous feature of the invention, the main and auxiliary cam elements are disposed in the vicinity of the pregripper support assembly. Consequently, there is only a slight axial spacing or none at all between the location at which force is introduced to the pregripper by the drive unit, and the location at which force is conducted to the pregripper bar. Thus, there is no lever arm which transmits the force in the axial direction, or such a lever arm is very small, so that the occurrence of torque is avoided. A transmission of bending vibrations or oscillations to the pregripper bar as a result of torsion is thereby precluded, which makes for uniform engagement or gripping of the sheets by the grippers of the pregripper bar.

In a further preferred feature of the invention, the main and auxiliary cam elements are disposed on a common drive shaft, which extends through preferably at least one recess of the pregripper support device, preferably, a first recess being associated with the main cam element and a second recess with the auxiliary cam element. It is thereby possible so to dispose the drive unit for performing the pivoting motion of the pregripper bar that a direct transmission of force to the pregripper support device can be effected, so that there is no need to interpose other force transmitting members. An introduction of the force for performing the pivoting motion can thus take place directly via the pregripper support device, so that the pregripper shaft serves the sole purpose of providing support and plays a secondary role in terms of force transmission to the pregripper bar.

In a further preferred construction of the invention, the pregripper support device has auxiliary supports assigned thereto which join or connect the pregripper bar to the pregripper shaft. Due to the auxiliary supports, the free ends of the pregripper bar advantageously experience additional guidance so that, at high machine or press speeds, i.e., at a very high repetition frequency of the pivoting or swiveling motion, an upswing of the pregripper bar at regions thereof distant from the location of force introduction is prevented. In this manner, the main force for producing the pivoting or swiveling motion is introduced substantially in the middle of the pregripper bar and, via the auxiliary supports, an auxiliary force is introduced from the pregripper shaft to the pregripper bar. This auxiliary force is of a magnitude which only assures the stability of the pregripper bar and prevents this bar from swinging upwardly.

Other features which are considered as characteristic for the invention are set forth in the appended claims.

Although the invention is illustrated and described herein as embodied in a pregripper of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
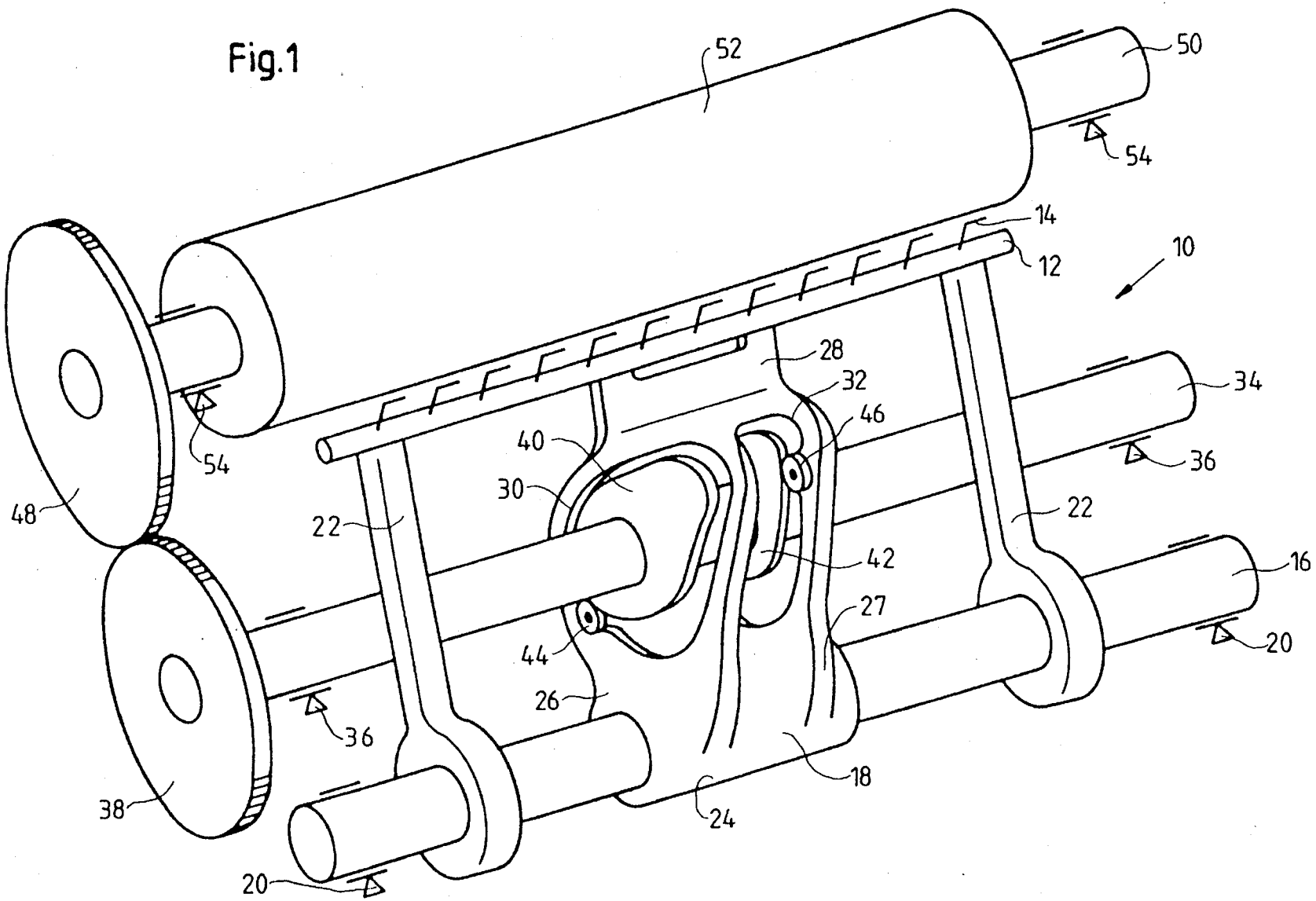
FIG. 1 is a perspective view of one embodiment of a pregripper of a sheet-fed printing press according to the invention.

Referring now to the drawings and, first, particularly to FIG. 1 thereof, there is shown therein, in a perspective view, a first embodiment of a pregripper 10 of a sheet-fed printing press constructed in accordance with the invention. The pregripper 10 has a pregripper bar 12 which carries a number of diagrammatically illustrated, spaced-apart grippers 14. The pregripper bar 12 is connected to a pregripper shaft 16 by a pregripper support device 18 mounted on the shaft 16 so that it is fixed against rotation relative thereto. The pregripper shaft 16 is rotatably supported at both ends thereof in diagrammatically illustrated bearings 20. The pregripper bar 12 is also connected to the pregripper shaft 16 by auxiliary supports 22 which, in the illustrated embodiment of FIG. 1, are respectively located at opposite sides of the pregripper support device 18, each of these auxiliary supports 22 engaging a respective free end of the pregripper bar 12. In the illustrated embodiment of FIG. 1, the auxiliary supports 22 are joined to the pregripper shaft 16 so as to be fixed against rotation relative thereto.

The pregripper support device 18 has a foot 24 formed with a bore through which the pregripper shaft 16 extends. From the foot 24, two disklike pregripper supports 26 and 27, which are disposed parallel to one another, extend in a direction towards the pregripper bar 12 and jointly terminate in a fastening region 28 which engages the pregripper bar 12. The pregripper support device 18 is disposed so that the fastening region 28 engages the pregripper bar 12 approximately midway along the length thereof. The pregripper supports 26 and 27 are formed with respective recesses 30 and 32, through which a drive shaft 34 extends. The drive shaft 34 is rotatably supported at both ends thereof in respective diagrammatically illustrated bearings 36. The drive shaft 34 carries, at a driving side thereof, a drive formed as a gearwheel 38 in the illustrated embodiment, the drive being connected to the drive shaft 34 so as to be fixed against rotation relative thereto. A main cam element 40 and an auxiliary cam element 42, hereinafter referred to as respective cam elements 40 and 42, are disposed on the drive shaft 34 so as to be fixed against rotation relative thereto. The cam elements 40 and 42 are located in the region of the pregripper support device 18, in particular in the respective recesses 30 and 32 formed in the pregripper supports 26 and 27, respectively. The recesses 30 and 32 are formed so that the respective cam elements 40 and 42 can revolve within them. The outer contour of the cam element 40 has a cam roller 44 assigned thereto which is secured to an edge of the pregripper support 26 defining the recess 30. Associated with the outer contour of the cam element 42 is a cam roller 46, which is disposed on an edge of the pregripper support 27 defining the recess 32. The cam rollers 44 and 46 are disposed, if projected into a plane, relative to one another on opposite sides of the drive shaft 34. The gearwheel 38 disposed on the drive shaft 34 so as to be fixed against rotation relative thereto meshes with a drivable gearwheel 48, which is disposed on a common shaft 50 of a processing unit 52 of the sheet-fed printing press. The processing unit 52 may be an impression cylinder, for example. The shaft 50 is journalled at both ends thereof in respective diagrammatically illustrated bearings 54.

The mode of operation of the pregripper 10 is hereinafter described with reference to FIG. 1:

Via a non-illustrated drive, the shaft 50 is driven so that the processing unit 52 disposed thereon is in rotation. The gearwheel 48 rotates synchronously with the processing unit 52. Depending upon a selected gear ratio between the gear wheels 48 and 38, the drive shaft 34 is set into opposing rotation relative to the shaft 50. The transmission or gear ratio between the gearwheels 48 and 38 can be chosen arbitrarily and is adjusted so that a hereinafter more fully described movement of the pregripper 10 occurs in synchronism with the rotation of the processing unit 52. At a selected transmission ratio of 1:1, an imaginary location or point on the drive shaft 34 and an imaginary location or point on the shaft 50 revolve once per unit of time in opposite directions. Due to the rotation of the drive shaft 34, the cam elements 40 and 42, which are disposed thereon so as to be fixed against rotation relative thereto, then rotate therewith. Via the cam rollers 44 and 46, which travel along the outer contours of the cam elements 40 and 42, respectively, a movement is transmitted to the pregripper support device 18 due to the rotary motion of the cam elements 40 and 42. Due to the fact that the cam rollers 44 and 46 are disposed on opposite sides of the drive shaft 34, a compressive force of varying strength is exerted on the cam rollers 44 and 46, respectively, in accordance with the cam path or course of the cam elements 40 and 42. The cam courses of the respective cam elements 40 and 42 are selected so that when the cam element 40 has an upward slope, i.e., exerts a pressure on the cam roller 44, the cam element 42 has a downward slope. In the regions wherein the cam element 40 has a downward slope, the cam element 42 has an upward slope, so that it exerts pressure on the cam roller 46. Because the cam rollers 44 and 46 are disposed on the pregripper supports 26 and 27, respectively, and these supports are rigidly connected to one another by the foot 24 and the fastening region 28, a reciprocating pivoting or swiveling motion of the pregripper support device 18 is effected, depending upon the position of the cam elements 40 and 42. Because both of the cam rollers 44 and 46 are in continuous engagement with the cam elements 40 and 42, respectively, which are associated therewith, the cam roller 44, for example, forms a transmission location for transmitting a motion force to the pregripper support device 18, while the other cam roller 46, for example, acts counter to this motion and controls the motion of the pregripper support device 18 and assures a marked freedom from play. Due to the cam track or course of the cam elements 40 and 42, the function of the cam rollers 44 and 46 alternates continually during the rotation of the drive shaft 34, so that the reciprocating pivoting or swiveling motion of the pregripper support device 18 is produced.

The pregripper support device 18 is connected to the pregripper shaft 16 so as to be fixed against rotation relative rotation thereto, so that this shaft 16 forms a pivot shaft for the pregripper support device 18. Transmission of the pivoting motion of the pregripper support device 18 to the pregripper bar 12 is effected via the fastening region 28, causing the bar 12 to pivot therewith accordingly. A transmission of force for the pivoting motion of the pregripper bar 12 is effected essentially via the fastening region 28, so that the force engages the pregripper bar 12 approximately centrally. Due to this central engagement of the force, a uniform distribution of force over the length of the pregripper bar 12 is achieved. Due to the fact that the force transmission is effected over a relatively constricted space and approximately centrally, production of an uneven or nonuniform bending strain on the pregripper bar 12 is largely precluded. Because the pregripper shaft 16 acts solely as a pivot shaft and essentially does not form a force transmission member for the pregripper bar 12, torsion of the pregripper shaft 16 cannot cause any deflection of the pregripper bar 12. Accordingly, it is possible for the grippers 14 fastened to the pregripper bar 12 to engage a sheet, which is oriented or aligned by front and side lays, uniformly, i.e., at the same location, so that uneven acceleration of the sheet is precluded, and the sheet is accelerated in a precisely defined position to press speed.

The auxiliary supports 22 disposed at both sides of the pregripper support device 18 transmit the pivoting or swiveling motion from the pregripper shaft 16 likewise to the pregripper bar 12. The flow of force via the pregripper support device 18, the pregripper shaft 16 and the pregripper supports 22, however, effects only a proportionately small introduction of force into the pregripper bar 12, in comparison with the essentially centrally engaging direct introduction of force accomplished via the pregripper support device 18. The auxiliary supports 22 serve solely to stabilize the pregripper bar 12 so as to prevent outward swinging of the ends of the pregripper bar 12.

Figure 2:
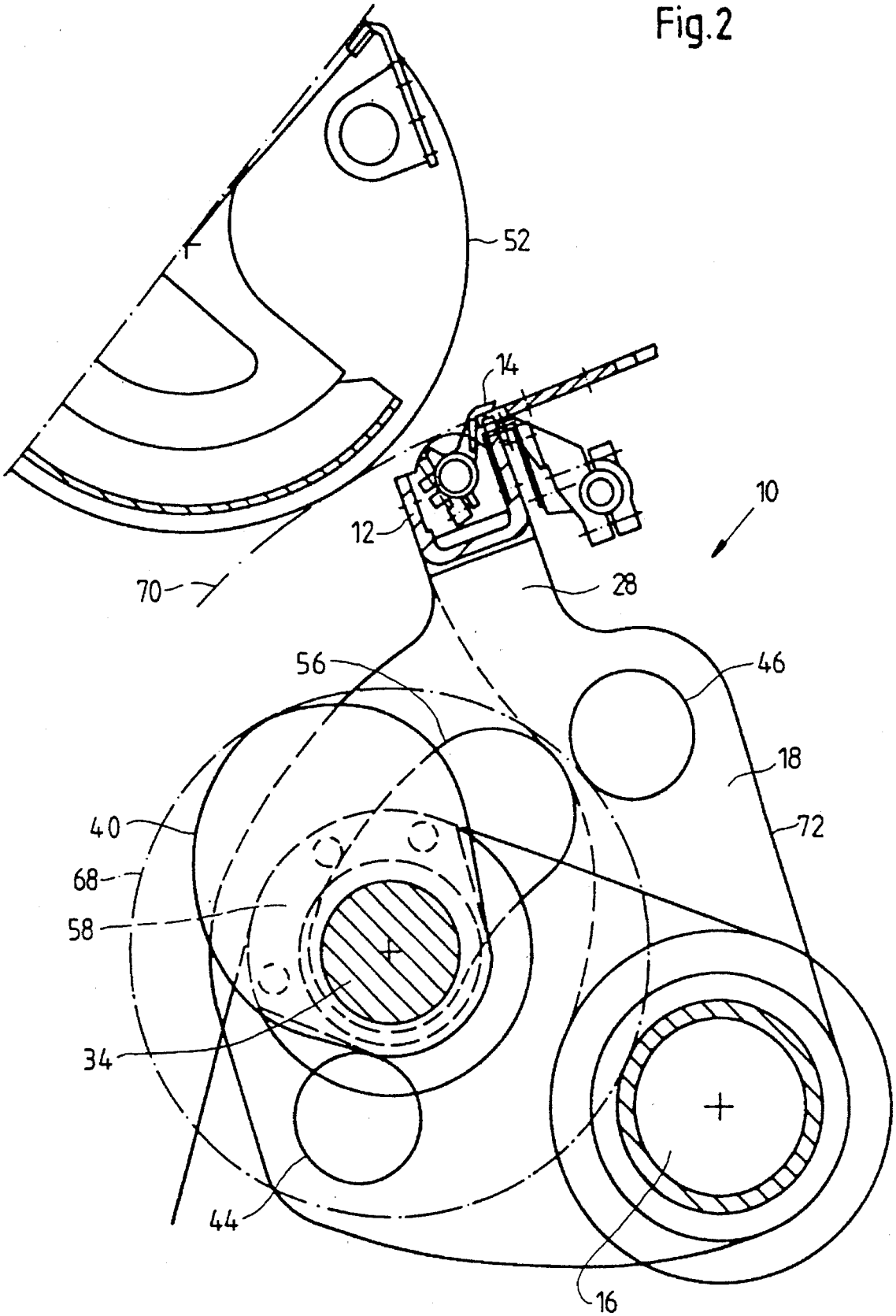
FIG. 2 is an enlarged fragmentary side elevational view, partly in section, of FIG. 1, showing another embodiment of the pregripper according to the invention.
Figure 3:
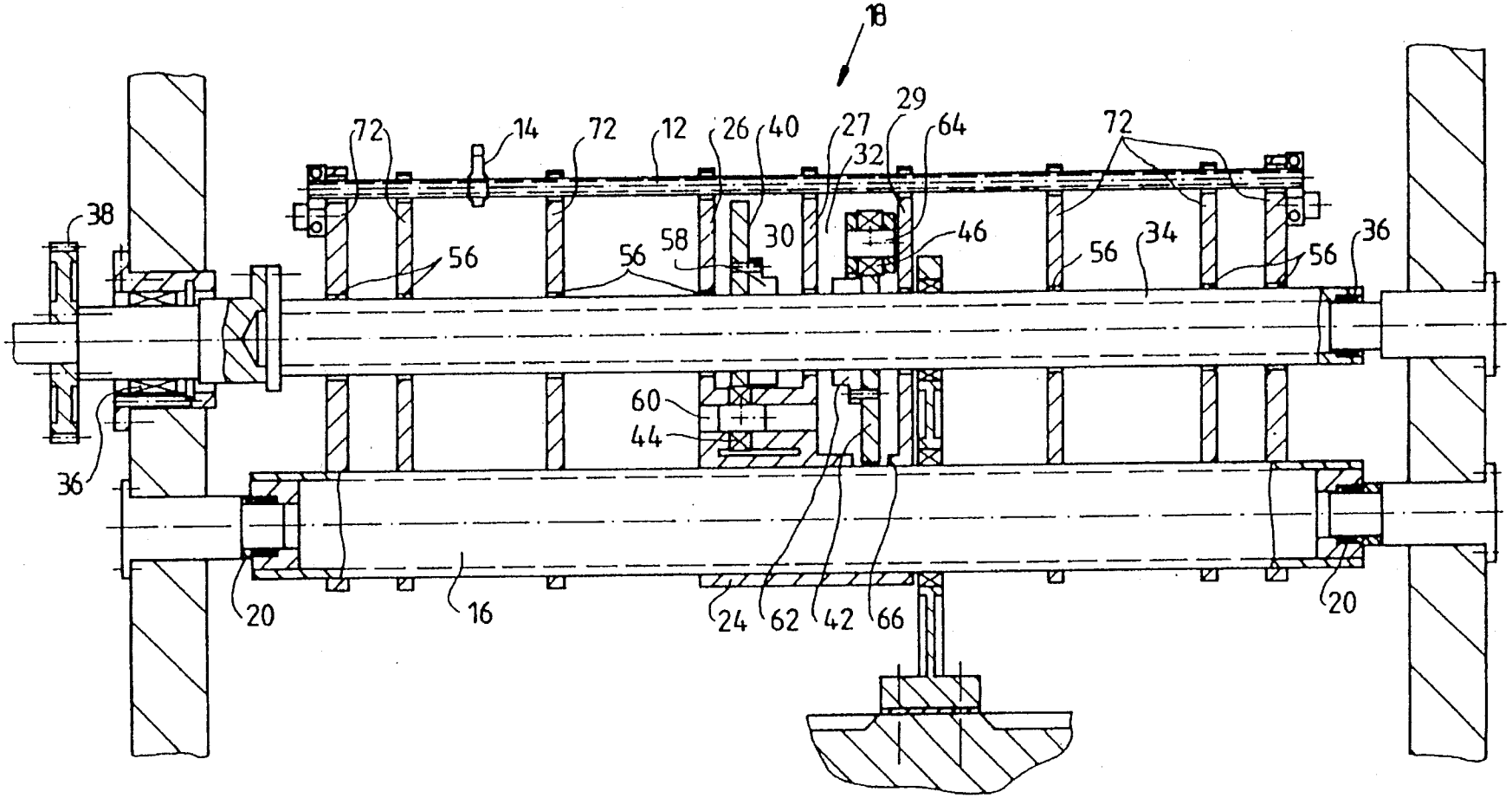
FIG. 3 is a fragmentary, reduced longitudinal sectional view of FIG. 2.

In FIGS. 2 and 3, another embodiment of the pregripper 10 according to the invention is shown in a side and partly cross-sectional view and a longitudinal sectional view, respectively. Elements corresponding to those shown in FIG. 1, although of somewhat different construction, are identified by the same reference numerals and not described again herein. In the exemplary embodiment shown in FIGS. 2 and 3, a multiplicity of auxiliary supports 72 are disposed over the length of the pregripper bar 12, in addition to the auxiliary supports 22. The pregripper support device 18 is disposed centrally on the pregripper shaft 16. It is made up of the pregripper supports 26, 27 and 29. Recesses 30 and 32 are formed between the pregripper supports 26, 27 and 29. Each of the pregripper supports 26, 27 and 29 is formed with a respective slot 56 through which the drive shaft 34 extends. The slot 56 is in the form of a circular arc and is located on an imaginary circumferential line surrounding the pregripper shaft 16. The maximum length of the slots 56 is dictated by the maximum pivoting or swiveling motion of the pregripper bar 12. The cam element 40 and the cam element 42 are mounted on the drive shaft 34 so as to be fixed against rotation relative thereto. Only the cam element 40 is shown in the side elevational view of FIG. 2. The cam elements 40 and 42, respectively, are disposed inside the recesses 30 and 32, respectively, of the pregripper support device 18. An advantage is achieved thereby in that the recesses 30 and 32 of FIG. 1 need not be adapted to the cam elements 40 and 42, but rather, only the slot 56 need be provided for receiving the drive shaft 34 therethrough.

As is clarified particularly in FIG.3, the cam element 40 is fastened to the drive shaft 34 via a flange 58. The pregripper supports 26 and 27 adjacent to the cam element 40 in the pregripper support device 18 form the common foot 24.

The foot 24 is formed, on the side of the drive shaft 34, with an axial through-opening 60 wherein the cam roller 44 is supported. The cam roller 44 is disposed so that it can cooperate with the outer contour of the cam element 40. The cam element 42 is likewise fastened to the drive shaft 34 via a flange 62. The cam element 42 is disposed adjacent to the pregripper support 29, which is likewise a component of the pregripper support device 18. A cam roller 46 fastened to this pregripper support 29 cooperates with the outer contour of the cam element 42. The cam roller 46 is, by way of example, fastened to a peg or protrusion 64 extending from the pregripper support 29. The pregripper support 29 which carries the cam roller 46 is likewise formed integrally with the foot 24. The foot 24 is formed with a recess 66 in the region of the cam element 42.

The function of the pregripper 10 shown in FIGS. 2 and 3 is equivalent to the function of the pregripper 10 shown in FIG. 1. As a consequence of the rotation of the drive shaft 34, the cam elements 40 and 42 revolve. The pregripper support device 18 traces or follows the outer contour of the cam element 40 via the cam roller 44, and the outer contour of the cam element 42 via the cam roller 46. Consequently, the aforementioned pivoting motion of the pregripper 10 occurs, with the pregripper shaft 16 acting as a pivot shaft. As is clear from FIG. 2, the cam element 40 describes a circular path 68 about the drive shaft 34. Because of the selected cam course or track of the outer contour of the cam element 40, the pregripper support device 18 is pivoted about the pregripper shaft 16. The requisite play for this pivoting motion is assured by the slots 56. The pivoting of the pregripper support device 18 causes the pregripper bar 12 to pivot and, as a result, the grippers 14, of which only one gripper 14 is shown in each of FIGS. 2 and 3, execute a pivoting motion over a circular path 70. Due to this pivoting motion, the aforementioned acceleration of sheets of paper to press speed in the direction of the processing unit 52 results. The introduction of force to the pregripper bar 12 is effected essentially by the three middle pregripper supports 26, 27 and 29, which are mutually connected in the pregripper support device 18. Via the auxiliary supports 72, of which, in the illustrated embodiment of FIG. 3, three are shown on each side of the pregripper support device 18, stabilization of the pregripper bar 12 is achieved, so that even at extremely high press speeds, torsional and/or bending vibrations of the pregripper 10 can be eliminated to a sufficient extent so that uniform acceleration of the sheets can be effected at any time.

I claim:

1. Pregripper of a sheet-fed printing press, comprising a drive unit for pivotally driving a pregripper bar secured to a pregripper support device, said drive unit having main and auxiliary cam elements disposed on a drive shaft so as to be fixed against rotation relative thereto, and cam follower members cooperatively engaging with said cam elements so as to produce a movement of said pregripper bar, said pregripper support device engaging said pregripper bar approximately centrally for introducing a force to produce the pivoting movement.

2. Pregripper according to claim 1, wherein said main and auxiliary cam elements are disposed in a region wherein said pregripper support device is located.

3. Pregripper according to claim 1, wherein said drive shaft supports both said main and auxiliary cam elements in common.

4. Pregripper according to claim 1, wherein said pregripper support device is formed with at least one opening through which said drive shaft extends.

5. Pregripper according to claim 4, wherein said pregripper support device is formed with a first and a second recess, respectively, assigned to said main cam element and said auxiliary cam element.

6. Pregripper according to claim 1, wherein said cam follower members associated with said main and auxiliary cam elements are formed as cam rollers and are mounted on said pregripper support device.

7. Pregripper according to claim 1, wherein said pregripper support device is formed with a first and a second recess, respectively, assigned to said main cam element and said auxiliary cam element, and wherein said cam follower members are formed as cam rollers, said cam roller associated with said main cam element being disposed in said first recess.

8. Pregripper according to claim 7, wherein said cam roller associated with said auxiliary cam element is disposed in said second recess.

9. Pregripper according to claim 5, wherein said pregripper support device has mutually spaced-apart first, second and third pregripper supports, said first recess being located between said first and said second pregripper supports, and said second recess being located between said second and said third pregripper supports.

10. Pregripper according to claim 9, wherein said main and said auxiliary cam elements are disposed axially spaced apart from the respective pregripper supports of said pregripper support device.

11. Pregripper according to claim 10, wherein said cam elements are formed as cam rollers and are secured on at least two of said pregripper supports of said pregripper support device.

12. Pregripper according to claim 9, including a pregripper shaft, and wherein said pregripper supports, respectively, of said pregripper support device are formed with a slot disposed along a circular arc about said pregripper shaft, said drive shaft extending through said slots.

13. Pregripper according to claim 12, wherein said pregripper support device is mounted on said pregripper shaft, and said pregripper shaft forms a pivot shaft.

14. Pregripper according to claim 1, including a pregripper shaft and auxiliary supports for connecting said pregripper bar to said pregripper shaft, said auxiliary supports being associated with said pregripper support device.

15. The pregripper of claim 14, wherein at least one of said auxiliary supports is disposed on each side of said pregripper support device.

* * * * *